United States Patent [19]

Copeland et al.

[11] Patent Number: 4,709,515

[45] Date of Patent: Dec. 1, 1987

[54] WET SANDBLASTING SYSTEM

[76] Inventors: Henry Copeland, 156 Barrios St.; Steve M. Copeland, Rte. 2, 307 Karen Dr., both of Lockport, La. 70374

[21] Appl. No.: 885,669

[22] Filed: Jul. 15, 1986

[51] Int. Cl.[4] ..... B24C 5/04; B24C 7/00

[52] U.S. Cl. ..... 51/436; 51/321; 51/438; 51/439; 222/132; 239/411; 239/415

[58] Field of Search ..... 51/263, 292, 319, 320, 51/321, 410, 427, 436, 438, 439; 239/410, 411, 414, 415, 304; 222/132, 136, 145, 630

[56] References Cited

U.S. PATENT DOCUMENTS

| | | | |
|---|---|---|---|
| 2,114,573 | 4/1938 | Rhodes . | |
| 2,176,577 | 10/1939 | Tirrell . | |
| 2,380,738 | 7/1945 | Eppler | 51/321 X |
| 2,387,193 | 10/1945 | Swenarton . | |
| 2,801,133 | 7/1957 | Ridley | 51/439 X |
| 3,070,924 | 1/1963 | Hastrup | 51/438 X |
| 3,201,901 | 8/1965 | Pauli | 51/438 X |
| 3,375,980 | 4/1968 | Hinrichs | 239/411 |
| 3,834,082 | 9/1974 | Grudzinski | 51/436 |
| 3,883,416 | 9/1974 | Fleischer | 51/321 X |
| 4,125,969 | 11/1978 | Easton | 51/320 |
| 4,412,402 | 11/1983 | Gallant | 51/439 |
| 4,517,774 | 5/1985 | Dudding | 51/436 |

*Primary Examiner*—Robert P. Olszewski

*Attorney, Agent, or Firm*—Fleit, Jacobson, Cohn & Price

[57] ABSTRACT

An apparatus by which wet sandblasting operations may be carried out with the operator disposed adjacent the discharge nozzle of the system having full control over the air, sand and liquid supplied to the discharge nozzle through the utilization of a single airflow control valve.

6 Claims, 7 Drawing Figures

52
54
56
60
76
16
WATER
RUST
INHIBITOR
10
62
74
58
14
50
48
64
68
38
70
R
36
66
32
18
39
28
40
46
34
26
12
47
SAND
42
24
20
22
44
30
METERING
VALVE

WET SANDBLASTING SYSTEM

BACKGROUND OF THE INVENTION

1. Field of the Invention

This invention relates to an apparatus by which wet sandblasting operations may be carried out with the operator disposed adjacent the discharge nozzle of the system having full control over the air, sand and liquid supplied to the discharge nozzle through the utilization of a single airflow control valve.

2. Description of Related Art

Various different forms of wet sandblasting systems heretofore have been provided such as those disclosed in U.S. Pat. Nos. 2,114,573, 2,176,577, 2,387,193, 3,833,416, 4,125,969, 4,412,402 and 4,517,774.

However, these previously known forms of wet sand blasting systems do not include the controls of the instant invention whereby one or more operators of wet sandblasting nozzles each may control the supply of air under pressure, sand and liquid to the associated nozzle through the utilization of a single airflow control valve.

SUMMARY OF THE INVENTION

The sandblasting system of the instant invention includes structure by which one or more wet sandblasting nozzles are provided and an operator for each nozzle is further provided a single airflow control valve which may be actuated to control the flow of air, sand and liquid to the corresponding nozzle. The system further incorporates structure whereby the liquid to be used in a wet sandblasting operation may be water and wherein liquid rust inhibitor may be metered into the flow of water. In this aspect of the invention, the single airflow control valve under the control of each nozzle operator also controls not only the flow of water to the nozzle but also the injection of liquid rust inhibitor into the water flow.

In a first disclosed form of the invention wherein a single sandblasting nozzle is provided and a single abrasive tank is incorporated for the abrasive to be used during a sandblasting operation. The tank is closed and automatically pressurized by the aforementioned airflow controlling valve upon opening of the latter. In addition, the tank includes a vent having a control valve operatively associated therewith and upon closing of the airflow controlling valve by the operator at the discharge nozzle, the vent valve is automatically opened and the supply of air for pressurizing the abrasive tank is cutoff.

In a second disclosed form of the invention, a large continuously pressurized tank is provided and multiple air and sand hoses extend from combined air and sand metering valves opening into the tank to an equal number of sandblasting nozzles each equipped with an airflow controlling valve each of which may be opened to cause air under pressure and abrasive to flow to the corresponding nozzle.

In the second disclosed form of the invention, structure also is provided for injecting water having rust inhibitor added thereto into each discharge nozzle for mixing with the air and sand passing therethrough.

The main object of this invention is to provide a wet sandblasting system constructed in a manner whereby the operator of the sandblasting nozzle may have full control over the flow of air and sand to the nozzle.

Another object of this invention is to provide a system in accordance with the immediately preceding object and whereby water as well as rust inhibitor is supplied to the nozzle for mixing with the air and sand flowing therethrough and wherein the single airflow control valve at the nozzle also controls the flow of water and rust inhibitor to the nozzle.

Yet another important object of this invention is to provide a system in accordance with the preceding object wherein a single abrasive tank is provided and supplies air and abrasive to multiple sandblasting nozzles each under control of the associated operator.

Another important object of this invention, in accordance with the immediately preceding object, is to provide a system wherein each of a plurality of nozzles also has the flow of water and rust inhibitor thereto under the control of a single airflow control valve at each nozzle.

A final object of this invention to be specifically enumerated herein is to provide a wet sandblasting system in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 7:
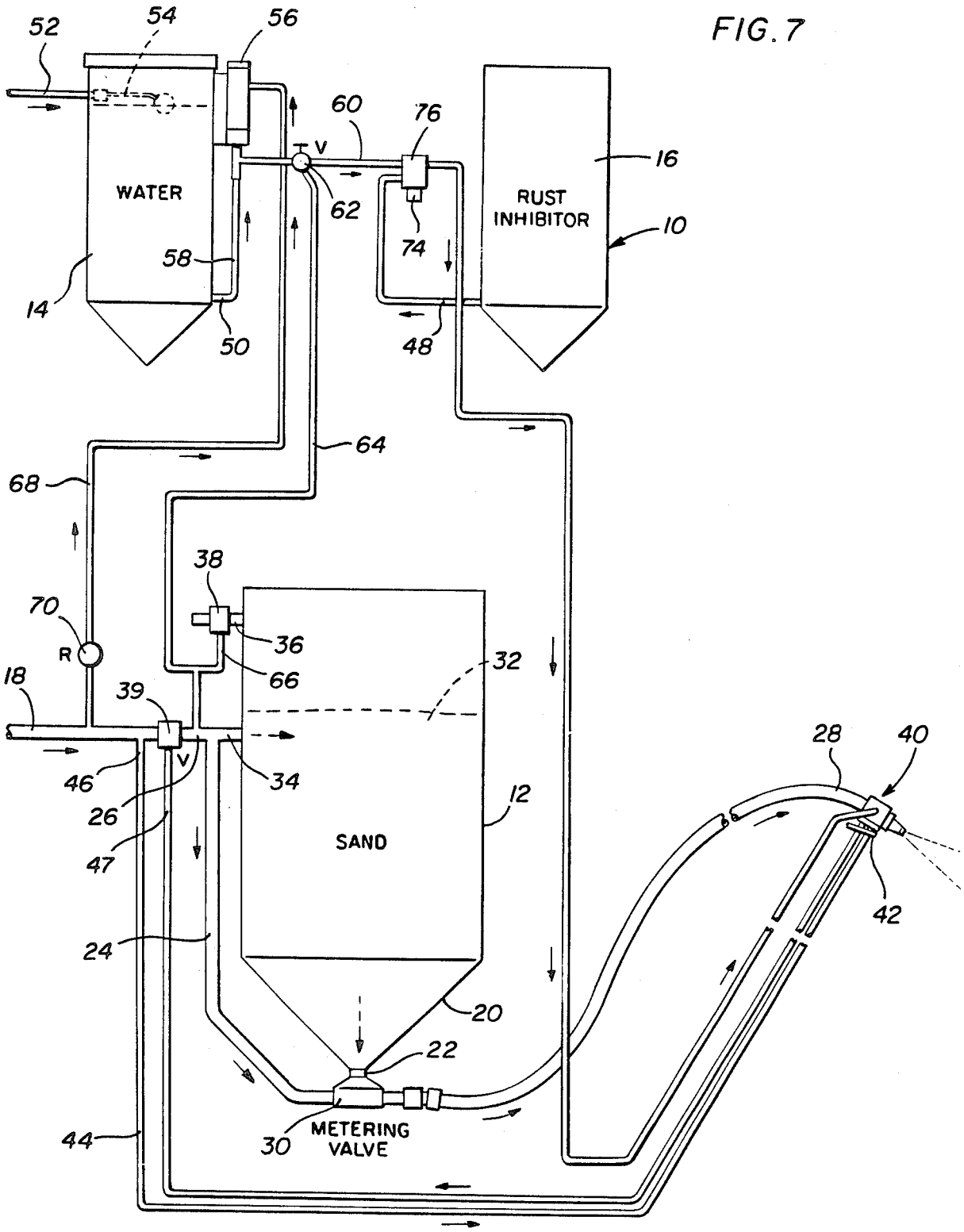
FIG. 7 is a diagrammatic view of a second form of sandblasting system constructed in accordance with the present invention and wherein only a single sandblasting nozzle is provided in conjunction with an internally pressurized single abrasive tank and a pair of attendant water and rust inhibitor tanks.

Referring now more specifically to FIG. 7 which illustrates a simplified form of sandblasting system referred to in general by the reference numeral 10, the system 10 includes an abrasive tank 12, a water tank 14, a liquid rust inhibitor tank 16 and a pressurized air supply line 18. The tank 12 includes a lower hopper bottom 20 including an abrasive outlet 22 and an air conduit 24 is provided and includes an inlet end 26 and an outlet end 28. A metering valve 30 is operatively associated with the outlet 22 for receiving abrasive therefrom and is serially connected in the air conduit 24. In addition, sand 32 may be disposed within the tank 12 to a predetermined level and the upper portion of the tank 12 includes an air inlet 34 communicated with the air conduit 24 and an air vent or outlet 36 opens outwardly of the upper portion of the interior of the tank 12 above the air inlet 34 and has a normally open air actuated valve 38 operatively associated therewith.

A normally closed air operated valve 39 communicates the pressurized air supply line 18 with the inlet end 26 of the air conduit 24 and the outlet end 28 of the air conduit 24 includes a sandblasting nozzle assembly referred to in general by the reference numeral 40. The nozzle assembly 40 supports an airflow control valve 42 therefrom serially connected in a control air line 44 including an inlet end 46 opening into the pressurized air supply line 18 upstream from the valve 39 and outlet end 47 opening into the valve 39 for operation thereof responsive to the valve 42 being opened. The valve 39 is normally closed and is opened when supplied air from the control air line 44 through the valve 42.

The rust inhibitor tank 16 includes a liquid rust inhibitor outlet 48 and the water tank 14 includes a water outlet 50, water being supplied to the interior of the tank 14 from a supply line 52 through a flow control valve 54. A pump 56 draws water through a suction line 58 communicated with the outlet 50 to the pump 56 and pumps water from the pump 56 through a delivery line 60 to the nozzle assembly 40, the delivery line 60 having a normally closed air operated valve 62 serially connected therein to which operating air is supplied through a control air conduit 64 opening into the inlet end 26 of the air conduit 24 downstream from the valve 39. The valve 38 is supplied control air through branch line 66 opening into the control air conduit 64. The pump 56 is air actuated and is supplied air through an air supply line 68 having a pressure reducer or regulator 70 serially connected therein. The line 68 includes an inlet end opening into the line 18 upstream from the valve 39 and an outlet end opening into the pump 56 for supplying operating air thereto. The pump 56 is of the type which stalls as a result of excessive back pressure on the liquid discharge therefrom. Accordingly, when the valve 62 is closed as a result of control air not being supplied thereto through the control air conduit 64, operation of the pump 56 automatically will be terminated, even though the supply of reduced operating air pressure thereto through the line 68 is uninterrupted.

A valve 74 controls the flow of rust inhibitor from outlet 48 to an injector 76 communicated with the interior of delivery line 60 and the injector 76 is operative to inject a metered quantity of inhibitor from the tank 16 into the pressurized water flowing through line 60.

Figure 4:
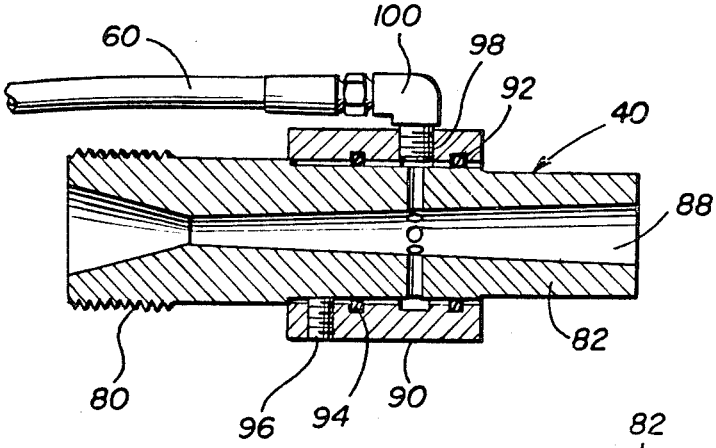
FIG 4. is a vertical sectional view taken substantially upon the plane indicated by the section line 4—4 of FIG. 3.
Figure 5:
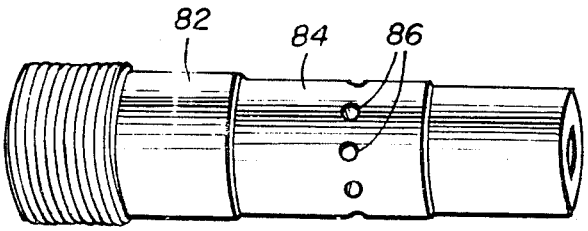
FIG. 5 is a perspective view of the internal component of the sandblasting nozzle.

With attention now invited more specifically to FIGS. 4 and 5 of the drawings, it may be seen that the nozzle assembly 40 is externally threaded as at 80 for threaded engagement on the outlet end 28 of the air conduit 24. The nozzle assembly includes a tubular inner member 82 incorporating a cylindrical outer surface area 84 through which radial bores 86 open outwardly, the radial bores 86 opening inwardly into the flared discharge end of a central passage 88 extending through the inner member 82. A collar 90 is slidably mounted on the portion 84 and includes a pair of axially spaced O-rings 92 and 94 sealing the interior of the collar 90 relative to the portion 84 and the collar 90 includes a setscrew 96 for releasably retaining the collar 90 in position about the portion 84 of the inner member 82. Further, the collar 90 includes a threaded radial bore 98 into which the outlet end of a fitting 100 is threadingly secured and the discharge line 60 is threaded into the inlet end of the fitting 100, the bore 98 opening into the interior of the collar 90 between the O-rings 92 and 94.

Figure 2:
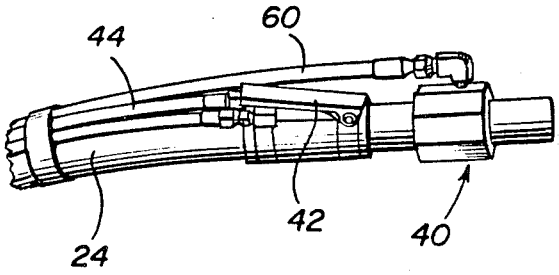
FIG. 2 is a perspective view of one of the sandblasting nozzles provided in conjunction with the tank illustrated in FIG. 1 and also illustrating the adjacent end of the air and sand hose, the water and rust inhibitor hose and the system controlling airflow control valve.
Figure 3:
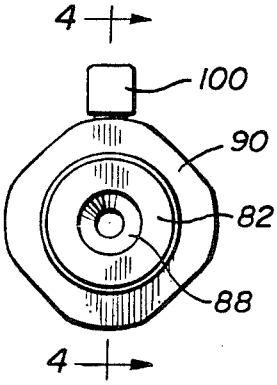
FIG. 3 is a front elevational view of the sandblasting nozzle illustrated in FIG. 2 as seen from the right side thereof.

From FIG. 2 of the drawings, it may be seen that the valve 42 is supported from the outlet end 28 of the air conduit 24, the valve 42 being serially connected in the line 44.

In operation, and assuming that the line 18 is pressurized, the operator at the nozzle assembly 40 may open the valve 42 to allow airflow therethrough whereby the normally closed valve 39 will be opened and air under pressure will be admitted into the interior of the tank 12 and also be allowed to flow through the air conduit 24, the metering valve 30 and to the nozzle assembly 40. In addition, once the valve 39 has been opened, air is supplied to the valve 38 through line 66 in order to close the same whereby the interior of the tank 12 will be pressurized. In this manner, air flowing through the metering valve 30 will meter sand 32 under pressure being discharged from the outlet 22 into the air flowing through the air conduit 24 to the nozzle 40. In addition, air will be supplied to the valve 62 through the conduit 64 in order to open the valve 62 thus relieving back pressure on the discharge of the pump 56 whereby the pump 56 will operate to pump water from the tank 14 into the line 60 and the by-pass line 72, valve 74 and injector 76 will function to inject a metered quantity of rust inhibitor from the tank 16 into the suction line 58 to the pump 56. Therefore, air and sand will be supplied to the nozzle 40 under pressure as well as a mixture of water and rust inhibitor.

When the operator at the nozzle assembly 40 releases the valve 42 in order to close the same, the vale 39 closes, the valve 38 opens and the valve 62 closes. Thus, the supply of air for pressurizing the interior of the tank 12 is terminated, the interior of the tank 12 is vented to the ambient atmosphere and the discharge from the pump 56 is blocked whereby the pump 56 will stall.

Figure 1:
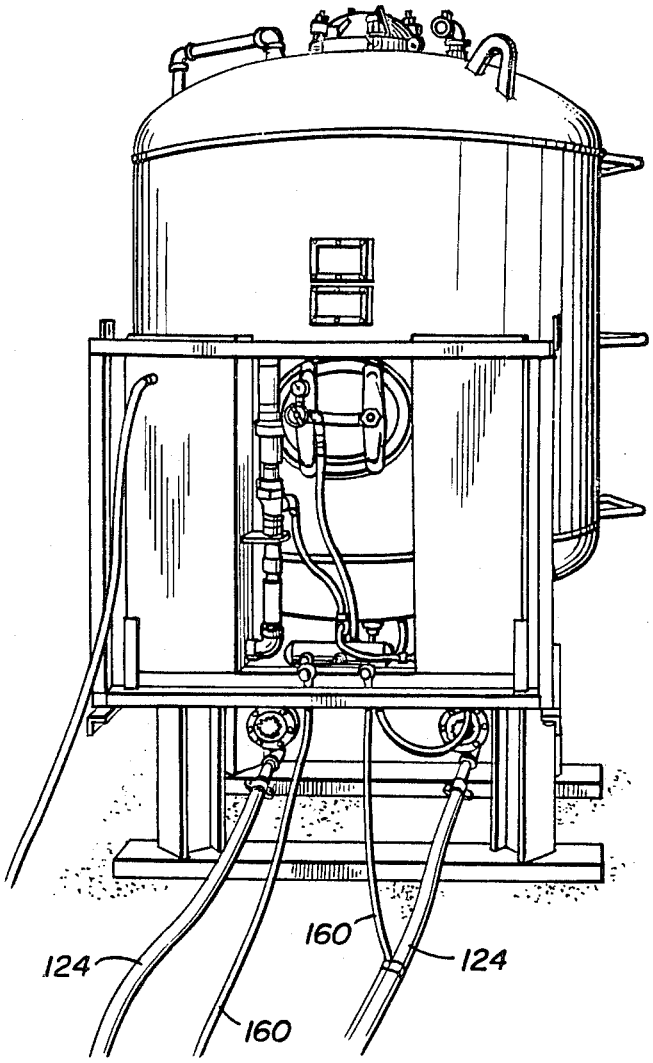
FIG. 1 is a front elevational view of a single pressurized abrasive tank incorporated in a first form of wet sandblasting system constructed in accordance with the present invention.
Figure 6:
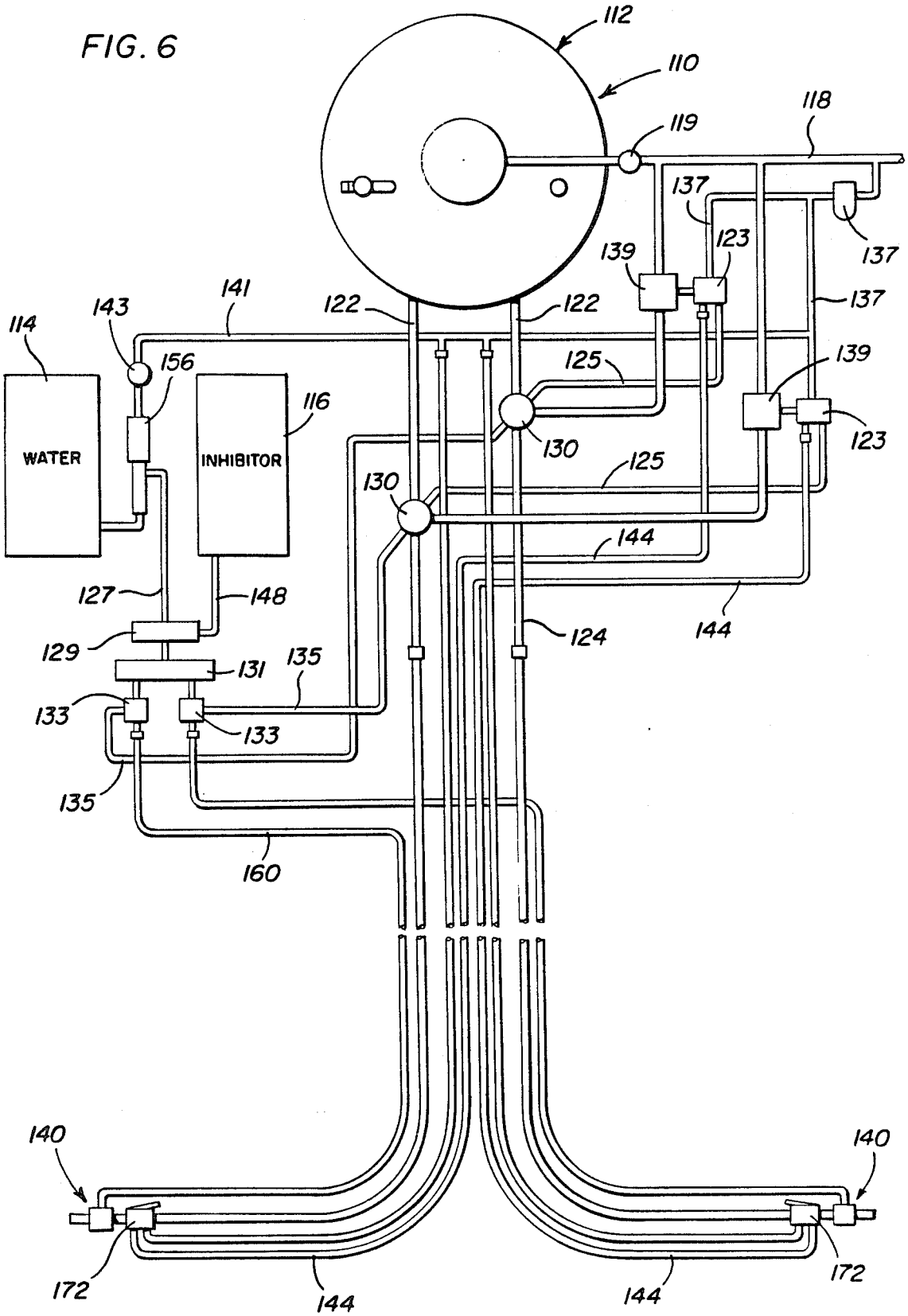
FIG. 6 is a diagrammatic view of the wet sandblasting system illustrated in FIGS. 1–5.

With attention now invited more specifically to FIGS. 1 and 6 of the drawings, there may be seen a second form of sandblasting system referred to in general by the reference numeral 110. The system 110 functions in generally the same manner as the system 10 and the various components of the system 110 finding corresponding components in the system 10 are designated by reference numerals similar to those utilized in conjunction with the system 10, but in the 100 series. The system 110 differs from the system 10 in that a single pressurized tank 112 is provided for a plurality of nozzle assemblies 140. The tank 112 includes a pair of outlets 122 extending to a pair of metering valves 130 and a pair of air conduits 124 extend to the corresponding pair of nozzle assemblies 140. A portion of the supply line 118 extending to the tank 112 has a manual valve 119 disposed therein and supplies air to the air conduits 124 through a pair of normally open air controlled valves 139 corresponding to the valves 39 having normally open air controlled pilot valves 123 operatively associated therewith to which air is supplied from control air lines 144 corresponding to the control air lines 44 and in which operator controlled valves 172 corresponding to the valves 72 are serially connected. The pilot valves supply controlling air to the air operated normally open metering valves 130 corresponding to the metering valves 30 through lines 125 and the discharge line 127 from the pump 156 opens into a single stage chemical metering valve 129 with which the outlet 148 of the rust inhibitor tank 116 is communicated. The metering valve 129 discharges into a surge tank 131 and the surge tank discharges into the delivery lines 160 corresponding to the delivery lines 60 through a pair of air operated normally open flow control valves 133 to which control air is supplied through lines 135 from the metering valves 130. The pilot valves 123 are connected to the supply line 18 through lines 137 and a filter 137' for control air.

With the system 110, the tank 112 is continuously pressurized as long as the valve 119 is open. By opening either valve 172, the corresponding pilot valve 123 is closed to thereby opening the associated valve 139 and valve 133. Each of the valves 172 may be provided with means for releasably latching the valve 172 in an open position. Accordingly, whenever either valve 172 is closed, the corresponding pilot valve 123, valve 139 and valve 133 are closed to terminate the flow of air, sand, water and rust inhibitor to the associated nozzle assembly 140.

Also, it will be noted that the line 137 includes a branch line 141 which supplies air under pressure through a regulator 143 through the pump 156 for operation thereof. The pump 156 corresponds to the pump 56 and is therefore continually operated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wet sandblasting system including a closed abrasive tank including abrasive outlet means, a pressurized air supply line, an air conduit including an air inlet end and an air outlet end, a discharge nozzle on said outlet end, air pressure openable and normally closed air valve means communicating said air line with said inlet end, a metering discharge valve operatively associated with said abrasive outlet means and serially disposed in said air conduit, a control air line including an inlet end communicated with said supply line upstream from said air valve means and an outlet end connected to said air valve means for actuation thereof, a control valve disposed adjacent said nozzle and serially connected in said control air line, liquid tank means having liquid outlet means, an air operated pump subject to stalling at a predetermined back pressure, a liquid delivery line including an inlet end and an outlet end, said pump being operatively connected to said liquid outlet means and said liquid delivery line inlet end for pumping liquid from said outlet means to said liquid delivery line inlet end, said nozzle including liquid injection means for injecting liquid into the air and abrasive stream passing through said nozzle, air supply means for supplying air under pressure from said air supply line upstream from said air valve means to said pump for operation thereof, air pressure openable and normally closed control valve means serially connected in said liquid delivery line, control air conduit means communicating said air conduit, downstream from said air valve means, with said control valve means for opening said control valve means, said air supply means including air pressure reducing means operatively associated therewith for reducing the pressure of air supplied to said pump relative to the pressure of air in said air conduit downstream from said air valve means, said outlet end of said liquid delivery line being communicated with said liquid injection means.

2. The system of claim 1 wherein said abrasive tank is closed and includes an air inlet above said abrasive outlet means and communicated with said air conduit downstream from said air valve means, said abrasive tank including a vent outlet, a normally open air operated valve operatively associated with said vent outlet, and control air supply conduit means including an inlet communicated with said air conduit downstream from said air valve means.

3. The system of claim 2 wherein said liquid tank means includes first and second liquid tanks each including a liquid outlet and together comprising said liquid outlet means, one of said liquid tanks having water disposed therein.

4. The system of claim 3 wherein the other of said tanks contains a quantity of liquid rust inhibitor.

5. The system as defined in claim 1 wherein said discharge nozzle includes a longitudinal hollow body connected to said air conduit, said liquid injection means including a collar on said body, said body including generally radial apertures communicating the interior of the collar with the interior of the body enabling liquid to pass from the collar into the air and abrasive passing through the hollow body.

6. The system as defined in claim 5 wherein said nozzle includes a longitudinally straight passage therethrough including inlet and outlet end portions and defining said nozzle interior, said outlet end of said air conduit opening into said passage inlet end portion, said passage outlet end portion being flared, said radial apertures opening into said passage outlet end portion.

* * * * *